US011952203B2

(12) United States Patent
Bodet et al.

(10) Patent No.: US 11,952,203 B2
(45) Date of Patent: Apr. 9, 2024

(54) TRIGGER-TYPE DISPENSING HEAD

(71) Applicant: LINDAL FRANCE SAS, Val de Briey (FR)

(72) Inventors: Hervé Bodet, Verdun (FR); Eric Gaillard, Dieue-sur-Meuse (FR)

(73) Assignee: LINDAL FRANCE SAS, Val de Briey (FR)

( * ) Notice: Subject to any disclaimer, the term of this patent is extended or adjusted under 35 U.S.C. 154(b) by 70 days.

(21) Appl. No.: 17/911,293

(22) PCT Filed: Mar. 18, 2021

(86) PCT No.: PCT/EP2021/056983
§ 371 (c)(1),
(2) Date: Sep. 13, 2022

(87) PCT Pub. No.: WO2021/185981
PCT Pub. Date: Sep. 23, 2021

(65) Prior Publication Data

US 2023/0131158 A1 Apr. 27, 2023

(30) Foreign Application Priority Data

Mar. 18, 2020 (FR) ..... 2002669

(51) Int. Cl.
*B65D 83/46* (2006.01)
*B65D 83/20* (2006.01)
*B65D 83/22* (2006.01)

(52) U.S. Cl.
CPC ..... *B65D 83/201* (2013.01); *B65D 83/226* (2013.01); *B65D 83/228* (2013.01); *B65D 83/46* (2013.01)

(58) Field of Classification Search
CPC ..... B65D 83/46
See application file for complete search history.

(56) References Cited

U.S. PATENT DOCUMENTS 10,130,964 B2 * 11/2018 Sun ..... A47K 5/1205
2007/0290006 A1 12/2007 Lott et al.
(Continued)

FOREIGN PATENT DOCUMENTS

DE 202009018628 U1 6/2012
DE 102014016261 A1 5/2016
EP 1661822 A1 5/2006

OTHER PUBLICATIONS

International Search Report and Written Opinion dated Jun. 18, 2021 in corresponding application No. PCT/EP2021/056983; w/ English partial translation and partial machine translation (total 18 pages).

*Primary Examiner* — Jeremy Carroll
(74) *Attorney, Agent, or Firm* — Seckel IP, PLLC

(57) ABSTRACT

The invention relates to a dispensing head comprising an insert (20) provided with a cam surface, a ring (10) on which is articulated a lever (30) provided with a trigger, and at least one cam follower. The lever and the cam surface can rotate relative to each other between a closed position and an open position. According to the invention, the insert (20) is configured to be blocked in rotation relative to the container (80) and to the stem (81) of the valve, the ring is an adjustment ring (10) which is configured to rotate relative to the container (80) and to the insert (20) about the main axis (A) of the valve to bring the lever (30) and the cam surface (22) into an open or closed position. Tamper-evident means can be provided in the insert to ensure the integrity of the dispensing head before the first use.

20 Claims, 7 Drawing Sheets

(56) References Cited

U.S. PATENT DOCUMENTS

Figure 1A:
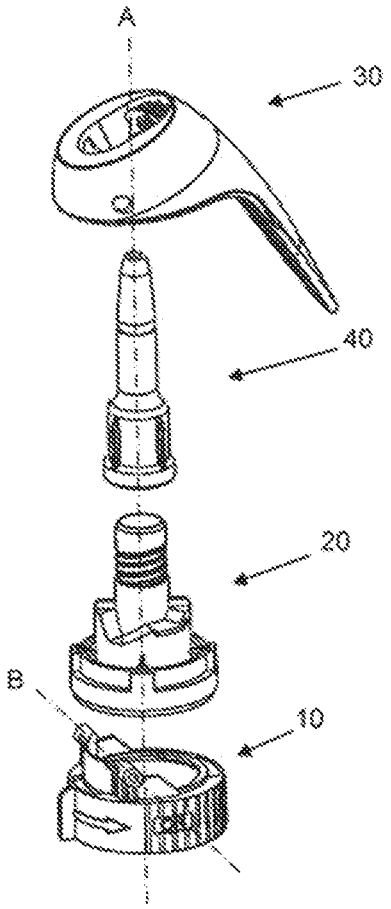

| | | | | |
|---|---|---|---|---|
| 2010/0237106 | A1 | 9/2010 | Wolf et al. | |
| 2012/0312896 | A1* | 12/2012 | Thurin | B65D 83/384<br>239/337 |
| 2019/0031426 | A1* | 1/2019 | Schroer | B65D 83/303 |
| 2020/0047980 | A1* | 2/2020 | Schroer | B65D 83/207 |

* cited by examiner

TRIGGER-TYPE DISPENSING HEAD

The invention relates to a trigger-type dispensing head for actuating a stem of a valve of a pressurized container. The dispensing head comprises (i) an insert provided with a cam surface and cooperating means for cooperating with the stem of the valve of the container to actuate the valve when the cam surface is moved towards the pressurized container, (ii) a ring on which is articulated (iii) a lever so that the lever can pivot relative to said ring about a pivot axis.

The lever is provided with a trigger and at least one cam follower configured to follow the cam surface as they are moved relative to each other. The dispensing head is configured to allow relative rotation of the lever with respect to the cam surface about a main axis between a closed position in which the cam follower or followers cannot move the cam surface towards the container to actuate the valve, and an open position in which the cam follower or followers can press on the cam surface and move it towards the container, thus actuating the valve.

Such dispensing heads are already known and are commonly used for so-called high-flow valves whose outlet rod (stem) is tilted to release large orifices. The objective of the invention is to develop a new dispensing head which is economical to manufacture and which operates reliably. Another objective is to make it possible to ensure the integrity of the product at the time of its first use.

This objective is achieved with a dispensing head in which the insert is configured to be blocked in rotation relative to the container and to the stem of the valve, the ring is an adjustment ring which is configured to rotate relative to the container and the insert about the main axis to bring the lever and the cam follower or followers into the open or closed position. The cam surface has at least one ramp inclined relative to a radial plane perpendicular to the main axis (A) so as to connect two points offset angularly and located in two planes offset axially relative to the main axis.

The pivot axis of the lever is preferably fixed on the ring.

The dispensing head is preferably provided with tamper-evident means configured to show that the dispensing head has never been used.

The insert can be provided with a crown provided with fixing means for fixing it on the pressurized container so as to be blocked in rotation relative to the pressurized container, the cam surface, and a cannula configured to be fitted onto the stem of the pressurized container, the cam surface surrounding the cannula close to one of its ends, the other end of the cannula constituting an outlet opening for the product.

The crown comprises at least one axial guide groove, and the cam surface can be provided with at least one tongue extending radially away from the crown, in which case the tongue or tongues are each configured to penetrate and slide in the or one of the guide grooves. These tongues and these guide grooves allow the cam surface and the crown to be two separate pieces while ensuring that the cam surface cannot rotate, or substantially not rotate, relative to the stem of the valve of the pressurized container.

When the insert is provided with tongues and corresponding guide grooves, the tamper-evident means can be constituted by at least one bridge which is broken at the time of the first use. The cam surface can in particular be connected to the crown by the bridge or bridges which are each located between the end of one of the tongues and the bottom of one of the guide grooves so that when the bridge or bridges are broken, the tongue or tongues can slide in the guide groove or grooves. It is self-evident that it would be possible to place the bridge or bridges elsewhere between the crown and the cam surface.

In a particular embodiment of the invention, the cam surface is constituted by two identical cam half-surfaces arranged symmetrically relative to the main axis, and the lever is provided with two cam followers.

The cam surface, or each cam half-surface, can be provided with at least two landings extending radially in two axially offset planes, the two landings being connected by a ramp. The cam surface or each cam half-surface is preferably configured to cause the lever to pivot, moving the trigger away from the pressurized container during the passage from the closed position to the open position by sliding of the cam follower or followers over the cam surface or cam half-surfaces. By following the cam surface, or the cam half-surfaces, and by sliding on the ramp during the passage from the landing closest to the pressurized container to the farther landing, the cam follower or followers move axially upwards, moving the trigger away from the pressurized container. When the cam follower or followers have reached the landing farther from the pressurized container, the trigger is spaced apart from the pressurized container and it is possible to pivot the lever to actuate the valve. For this purpose, the cam follower or followers press on the cam surface or the cam half-surfaces which move axially towards the pressurized container and cooperate by their cooperation means with the valve to open it.

The insert can be provided, preferably in its crown, with at least one recess open radially towards the outside and provided with two abutment surfaces, and the adjustment ring is provided with a rib extending radially towards the inside, the rib being configured to penetrate into the recess, and the abutment surfaces being configured to limit the rotation of the adjustment ring relative to the insert, thus blocking the movement of the rib in the recess between two extreme positions.

To facilitate handling of the adjustment ring, the latter can be provided on its outer face with gripping means. The gripping means can be a fin extending radially towards the outside, or reliefs.

The crown of the insert is preferably configured to take place inside the adjustment ring. For this purpose, retaining means are provided to prevent a relative movement of the crown and of the adjustment ring in the axial direction while allowing a relative rotational movement about the main axis of the valve.

In a particular embodiment, the adjustment ring is provided with a tubular wall closed at one of its ends by an annular wall forming a central opening, and with a curved wall extending axially, which curved wall is placed on the annular surface opposite from the tubular wall and partially surrounding the central opening, the rotation axis of the lever passing through said curved wall.

The rotation axis of the lever can be constituted by, on the one hand, two half-axles, and on the other hand, two bearings, the half-axles being placed either on the adjustment ring, in particular on the curved wall, or on the lever, and the two bearings being placed on the other of these two parts.

The insert can be provided with attachment means for attaching a dispensing endpiece. The attachment means are preferably constituted by a threading. The attachment means are preferably located on the cannula.

The lever is preferably provided with an oblong opening through which passes a portion of the insert, in particular the cannula, and/or a dispensing endpiece attached to the insert, in particular to the cannula.

The invention is described in more detail below with help of the figures which show:

1st Embodiment

Figure 1B:
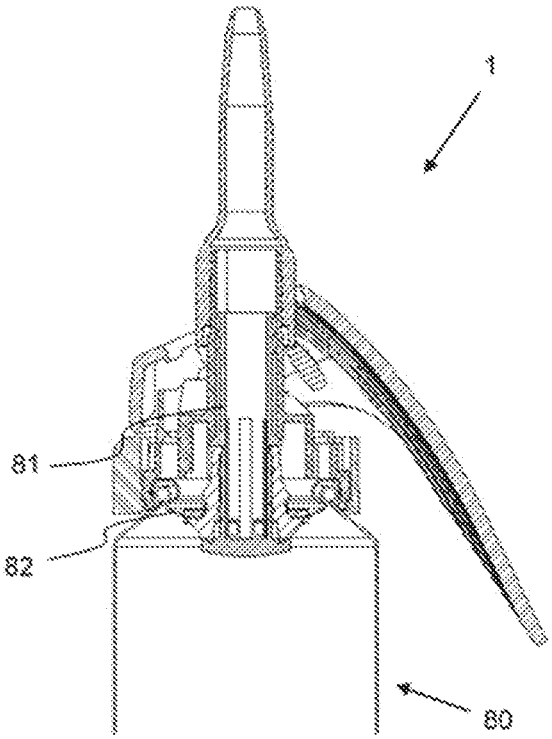
Figure 2A:
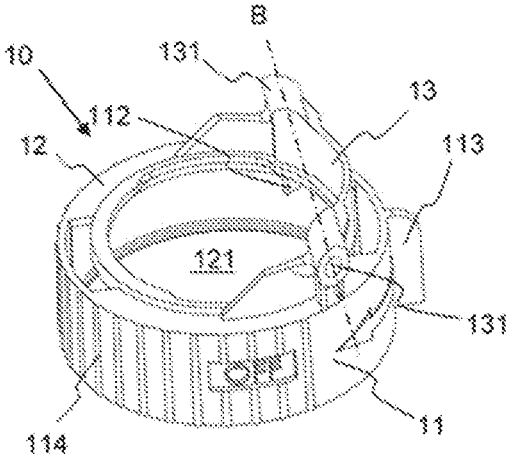
Figure 2B:
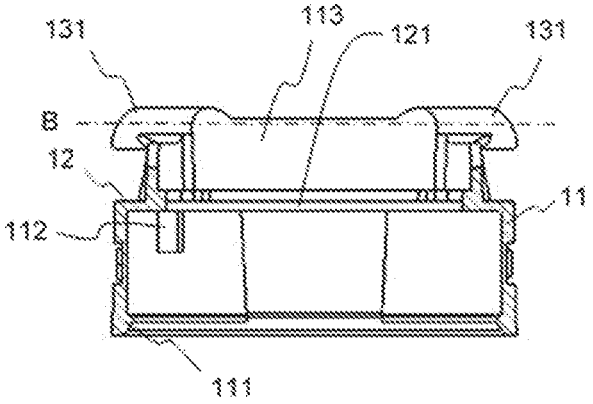
Figure 3A:
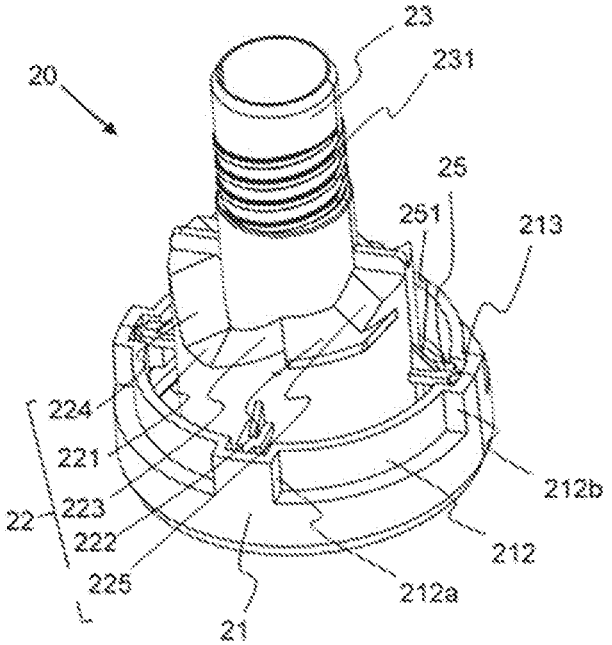
Figure 3B:
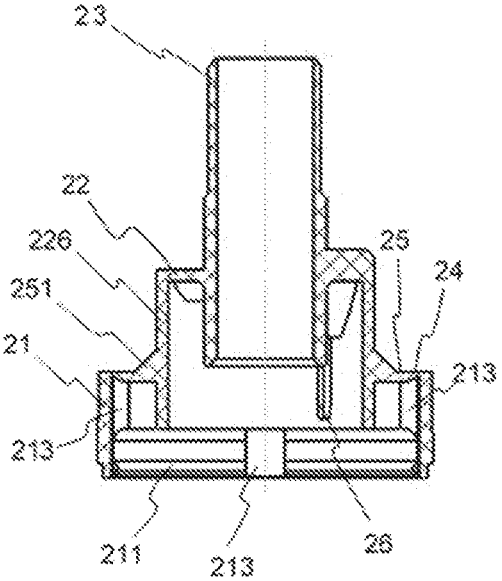
Figure 3C:
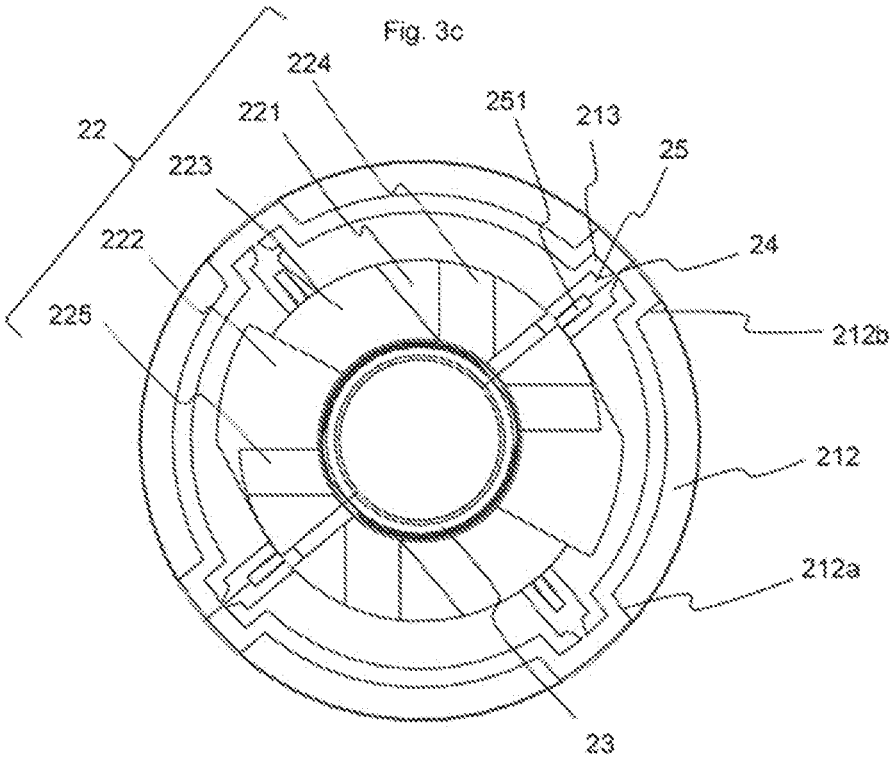
Figure 4A:
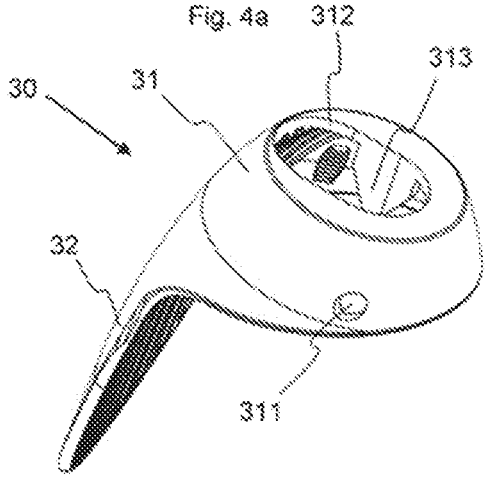
Figure 4B:
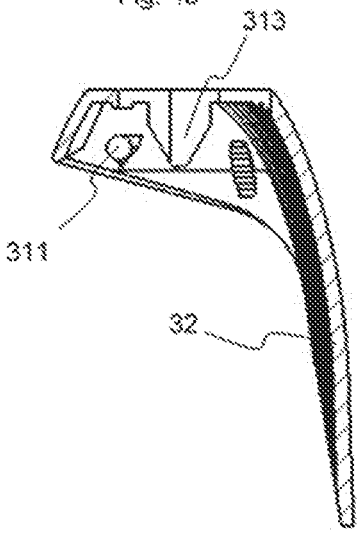
Figure 4C:
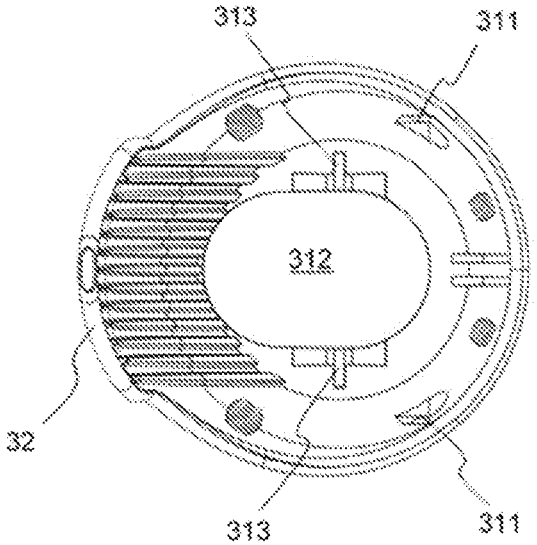
Figure 6:
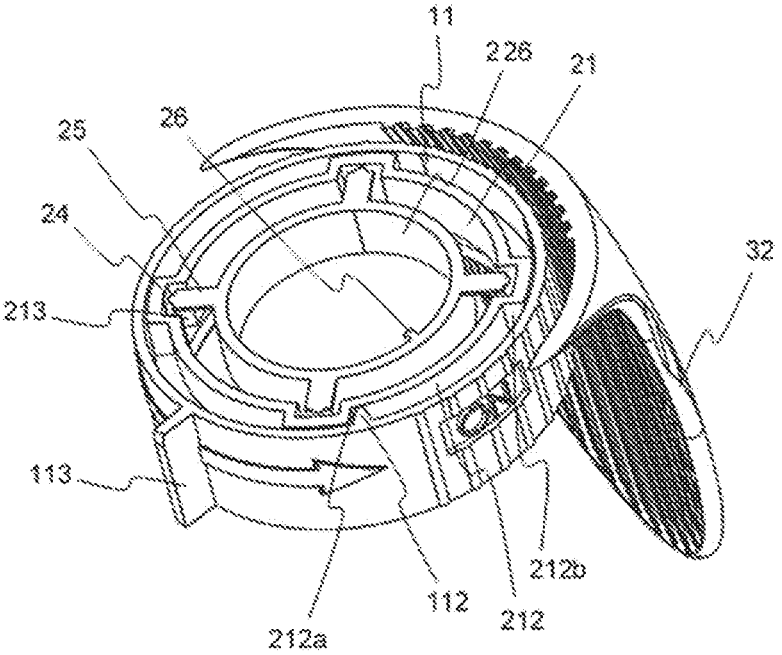

FIG. 1 the dispensing head of the invention (a) in exploded view and (b) in cross-section view, mounted on a pressurized container equipped with a high-flow valve;

FIG. 2 the adjustment ring of FIG. 1, (a) in perspective view and (b) in longitudinal cross-section on view;

FIG. 3 the insert of FIG. 1, (a) in perspective view, (b) in longitudinal cross-section view, and (c) in plan view from above;

FIG. 4 the lever of FIG. 1, (a) in perspective view, (b) in longitudinal cross-section view, and (c) in plan view from below;

FIG. 5 a cross-section view showing the cooperation of the lever and the insert, (a) in the closed position and (b) in the open position of the adjustment ring;

FIG. 6 a horizontal cross-section view of the dispensing head according to the first embodiment;

2nd Embodiment

Figure 7A:
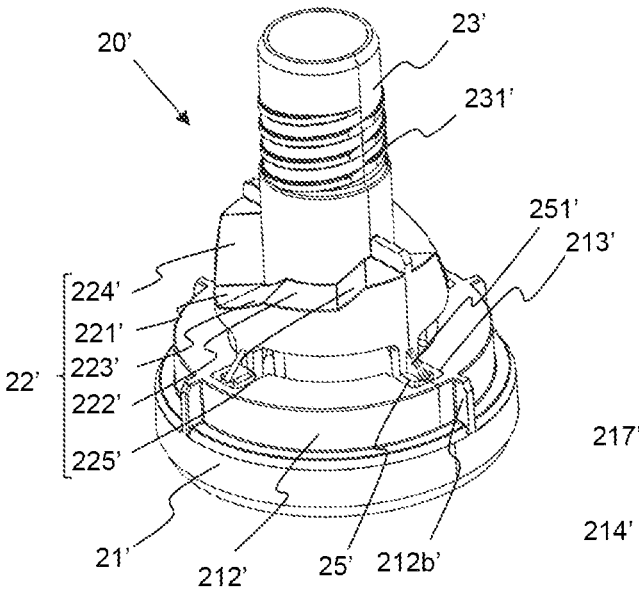
Figure 7B:
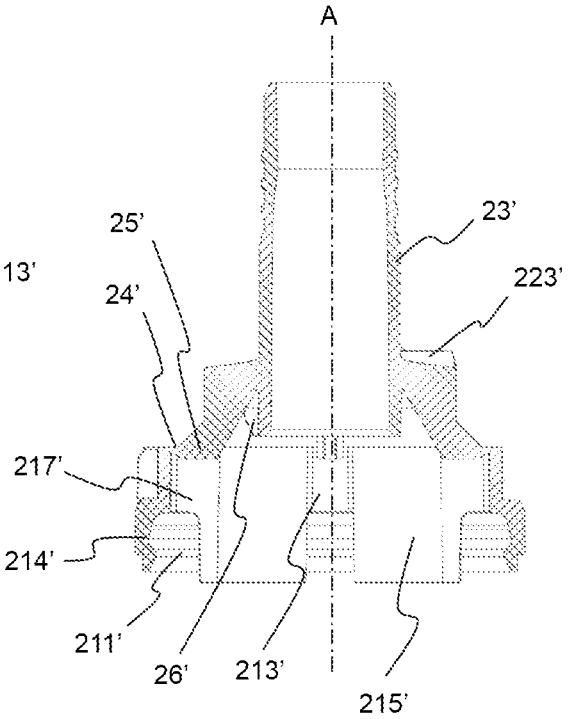
Figure 7C:
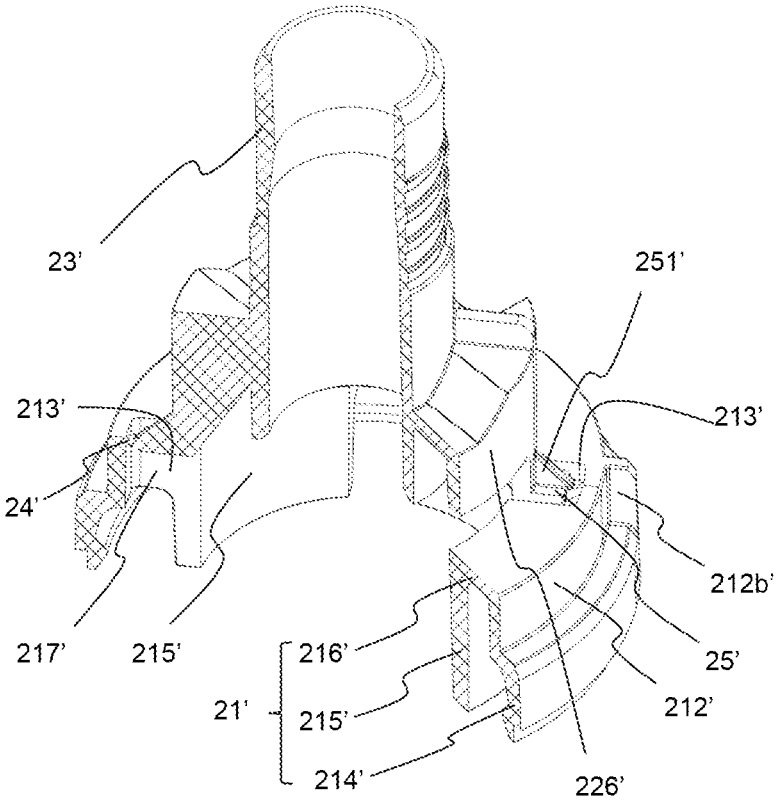
Figure 8:
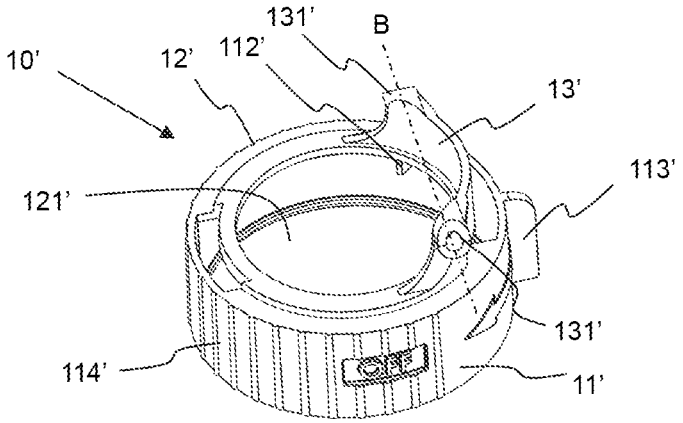
Figure 9:
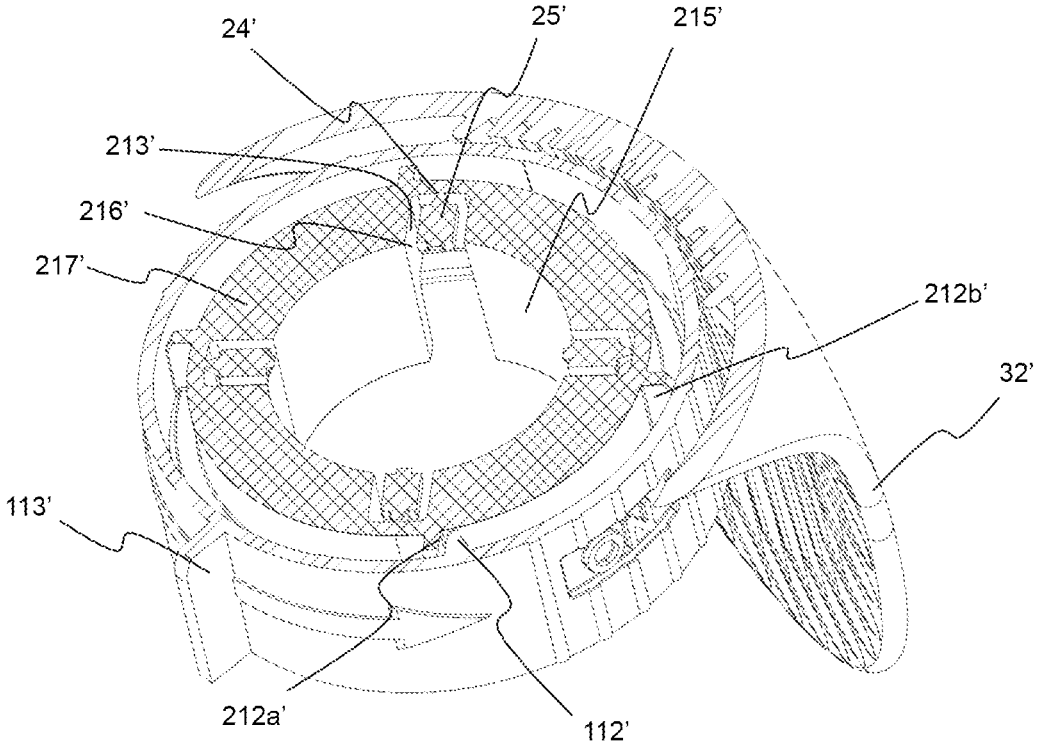
Figure 10:
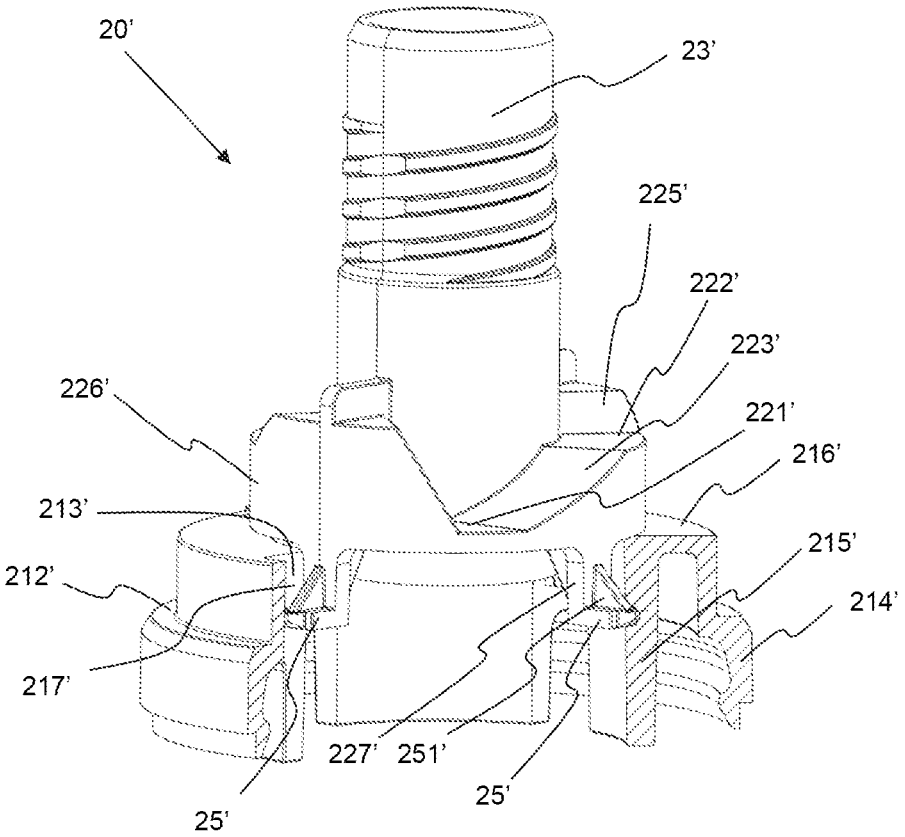

FIG. 7 an insert for a second embodiment (a) in perspective view, (b) in longitudinal cross-section view at the slots, and (c) in perspective and longitudinal cross-section view at 45° relative to the slots;

FIG. 8 an adjustment ring of the second embodiment, in perspective view;

FIG. 9 a horizontal cross-section view of the dispensing head according to the second embodiment;

FIG. 10 a perspective view of the insert in which a portion of the crown has been cut off, the cam surface and the cannula being in the depressed position to actuate the valve.

The invention relates to a dispensing head (1) for actuating the rod (81) of the valve of a pressurized container (80). The rod (81) is also known as the stem. It can be, as in FIG. 1*a*, a so-called "high flow" valve with a valve stem mounted on an elastic sleeve to allow opening by tilting the stem out of its longitudinal axis. It can also be a traditional valve, male or female.

In general, the dispensing head and its various components have a certain symmetry about a main axis (A) passing through the outlet conduit of the stem (81) of the valve for which it is intended when the dispensing head is mounted on a pressurized container. The adjectives "radial" or "axial" relate to this main axis (A) and are synonymous with substantially "perpendicular to the axis" and substantially "parallel to the axis". The dispensing head is shown in the figures in a vertical position with the product outlet opening oriented upwards. Spatial references such as "top" and "bottom", "above" and "below", "horizontal" and "vertical", used in the description relate to the dispensing head thus shown. The dispensing head can however be used in any other position, and what is represented "above" can in reality be in a completely different position, and in particular end up for example "below" if the dispensing head is used upside down.

The dispensing head of the invention is composed mainly of an adjustment ring (10, 10'), an insert (20, 20'), and a lever (30) articulated on the adjustment ring. It is also possible to provide on the insert a dispensing endpiece (40) adapted to the product to be dispensed.

Two embodiments are shown in the figures. These two embodiments being very similar, only the insert (20') and the adjustment ring (10') are shown for the second embodiment, the lever and the dispensing endpiece remaining practically unchanged.

The insert (20, 20') is composed mainly of a crown (21, 21'), a cam surface (22, 22'), and a cannula (23, 23').

The crown (21, 21') is configured to fix the insert to the pressurized container (80), for example on the rolled edge of the cup (82) of the valve. For this purpose, the crown (21, 21') is provided with fixing means (211, 211') which in the present example have the shape of a retaining ring intended to be snapped behind the rolled edge of the cup. This fixation is so that the crown (21, 21') is fixed relative to the pressurized container (80), and in particular so that it cannot rotate about the main axis (A) in the absence of a strength greater than that expected for normal use of the dispensing head.

In addition, the crown (21) is provided on its outer surface with four identical recesses (212, 212') distributed regularly over its periphery. Each recess is delimited by two vertical radial abutment surfaces (212*a*, 212*b*, 212*a*', 212*b*'). In addition, four vertical guide grooves (213, 213') are provided on the inner face of the crown. In the first embodiment, the guide grooves are placed between the abutment surfaces (212*a*, 212*b*) of two successive recesses (212). In the second embodiment, the recesses (212') are separated by simple vertical ribs whose two side faces define an abutment surface (212*a*', 212*b*') of two successive recesses. In addition, the crown (21') of the second embodiment comprises a tubular outer wall (214'), on the outer face of which are placed the recesses (212'), and an inner skirt (215'), also tubular, divided in four segments. Each segment is connected to the outer wall (214') (i) at its top by a substantially horizontal connecting wall (216') and (ii) in the upper portion of its longitudinal edges by vertical connecting walls (217'). The connecting wall is common to the four segments and has an annular shape. The guide grooves (213') are located between the vertical connecting walls (216') of two successive skirt segments (215') and the outer wall (214'). In both embodiments, the number of guide grooves is not necessarily equal to four. It would of course be possible to provide only one. One could also provide two, three, five, or six, for example.

The cam surface (22, 22') has two identical portions arranged symmetrically about the main axis (A). Each portion, or cam half-surface, has an arcuate shape which is substantially helical along the main axis (A). In the present example, each cam half-surface is stepped and has two radial landings (221, 221', 222, 222') each extending horizontally in a different radial plane. The corresponding landings of the two half-surfaces are located in the same radial plane. The first horizontal landing (221, 221') is located closer to the lower edge of the crown (21, 21') and therefore to the cup of the valve to be actuated than the second horizontal landing (222, 222'). In other words, the first horizontal landing (221, 221') is lower than the second horizontal landing (222, 222'). The two horizontal landings are connected to each other by a ramp (223, 223') with continuous progression. Upstream of the first landing (221, 221'), and thus opposite from the ramp (223, 223'), the first horizontal landing (221, 221') is continued by a first stop surface (224, 224'), just as the second horizontal landing (222, 222') is continued downstream, and thus opposite from the ramp (223, 223'), by a second stop surface (225, 225').

At the center of the cam surface is a cannula (23, 23') having a tubular shape and extending axially, away from the crown (21, 21') and the cam surface (22, 22'). The inner diameter of the cannula is configured to fit the cannula onto the stem (81) of the pressurized container, preferably sealingly. The fitted adjustment of the cannula performs the function of cooperating means with the stem (81) of the valve: if the cam surface (22, 22') is moved towards the valve and the pressurized container, the cannula which is attached to the cam surface is also moved downwards and takes the stem along, causing the valve to open.

Additionally, the outer face of the cannula can be configured to attach a dispensing endpiece (40) thereto. For this purpose, it can be provided for example with attachment means which are here in the form of a threading (231, 231'). This makes it possible to adapt the dispensing endpiece (40) to the product to be dispensed and to the intended applications. The dispensing endpiece can be closed by a cap (41).

The outer edge of the cam surface can be extended by a tubular skirt (226, 226'), which is cylindrical in the present example, the tubular skirt extending in the direction opposite from the cannula. In the second embodiment, the skirt stops at the first horizontal landing (221').

The cam surface (22, 22') can be connected to the crown (21, 21') by fragile connecting means, such as bridges of material (24, 24'), so that, for example, pressure exerted downwards on the cam surface (22, 22') is sufficient to break these connecting means (24, 24') These bridges constitute tamper-evident means. In addition, the cam surface can be configured so that it is blocked in rotation relative to the crown. In the example presented here, the cam surface (22, 22') is provided with four tongues (25, 25') configured to slide in vertical guide grooves (213, 213') made in the inner face of the crown (21, 21'). In the first embodiment, the tongues (25) and the bridges of material (24) are placed on the tubular skirt (226), protruding radially toward the outside. To avoid deformation of the tongues (25) when the bridges (24) break, it is possible to provide reinforcements, for example in the form of brackets (251, 251') placed in abutment against the skirt (226), or extension lugs (227'), and the tongue. Like for the guide grooves, it would of course be possible to provide only one tongue, or any other number, in particular two, three, five, or six tongues. Before the first use, the bridges (24, 24') each connect the free end of a tongue (25, 25') to the bottom of the corresponding guide groove (213, 213'), preferably to the upper end of the guide groove (213, 213') and of the crown (21, 21'). The cam surface (22, 22') and the cannula (23, 23') preferably form a single-piece unit.

The adjustment ring (10, 10') is constituted by a tubular wall (11, 11') continued at its upper end by a radial annular wall (12, 12') extending towards the main axis (A), thus defining a central opening (121, 121'). A curved, arcuate wall (13, 13') surrounds a portion of the central opening (121, 121') while extending axially. The arcuate wall is placed on the radial annular wall (12, 12') on the face opposite from the tubular (11, 11'). This arcuate wall (13, 13') carries two aligned projections (131, 131') each defining a pivot half-axle for the lever.

The tubular wall is configured to connect the adjustment ring (10, 11') to the insert (20, 20') so as to block them in axial translation relative to each other while allowing rotation of one relative to the other about the main axis (A). For this purpose, the tubular wall (11, 11') is sized to receive the crown (21, 21') of the insert in the space defined by its inner face. Retaining means are provided on the inner face of the tubular wall. These retaining means are here in the form of a retaining ring (111, 111') which snaps into place below the lower edge of the crown (21, 21') of the insert.

A vertical and radial rib (112, 112'), oriented towards the center of the adjustment ring, is placed on the inner face of the tubular wall (11, 11'). This rib is configured to penetrate into one of the four recesses (212, 212') of the crown (21, 21') of the insert (20, 20'). The relative movement of the adjustment ring (10, 10') with respect of the insert (20, 20') is limited by the two abutment surfaces (212*a*, 212*b*, 212*a*', 212*b*') of the recess (212, 212') in which the rib is located.

A vertical and radial fin (113, 113') and reliefs, for example vertical ribs and/or grooves (114, 114'), are placed on the outer face of the tubular wall (11, 11') and serve as gripping means allowing the user to rotate the adjustment ring relative to the insert.

The lever (30) is essentially composed of a ring (31) continued by a trigger (32). The ring is configured to pivot on the adjustment ring (10, 10') about a pivot axis (B) perpendicular to the main axis (A). For this purpose, the ring is provided with two openings (311) each serving as a bearing, into which the two projections (131, 131') of the adjustment ring penetrate. The lever is thus interconnected with the adjustment ring while being able to pivot relative to the latter. The pivot axis (B) is fixed relative to the adjustment ring, so that it always remains in a same radial plane regardless of the rotational position of the adjustment ring (10, 10') relative to the insert and the pressurized container.

The ring is provided at its top with an oblong opening (312) constituting a passage for the cannula (23, 23') and, where appropriate, the dispensing endpiece (40).

On each longitudinal edge of the oblong opening (312) is located a cam follower (313). These two cam followers are configured, on the one hand, to follow the cam surface (22, 22') during a rotation of the adjustment ring (10, 10') relative to the insert (20, 20'), and on the other hand, to press on the cam surface when a user presses the trigger (32). These cam followers preferably have a triangular shape, with the base of the triangle located on the side of the oblong opening (312) and the tip pointing downwards, and thus towards the cam surface.

During packaging, a dispensing head (1) according to the invention is placed on the stem (81) of the valve of a pressurized container (80). For this purpose, the stem is introduced into the cannula (23, 23') and the insert is fixed with its fixing means (211, 211') on the pressurized container, in the present case, on the rolled edge of the cup. The crown (21, 21') of the insert is thus blocked in axial translation and in rotation relative to the valve cup and more generally relative to the pressurized container. The skirt (215') of the second embodiment makes it possible in particular to properly center the dispensing head on the valve, allowing a properly vertical descent. This prevents the outlet rod (81) from being inadvertently tilted when the dispensing head is put in place, at the risk of opening the valve. When the dispensing head is mounted on a pressurized container, the lever can pivot between a high extreme position and a low extreme position. In the high extreme position, the end of the oblong opening (312) opposite from the pivot axis (B) abuts against the cannula (23) or the dispensing endpiece (40). In the low extreme position, the lever cannot pivot any further, for example, because the trigger (32) of the lever touches the housing of the pressurized container or bears against a stop provided for this purpose.

The operation of the dispensing head of the invention is explained in more detail below.

As mentioned previously, the adjustment ring (10, 10'), and with it the cam followers (313), can rotate relative to the insert (20, 20'), and consequently, relative to the cam surface, between an open position and a closed position. This relative rotation is limited by the abutment of the rib (112, 112') of the adjustment ring against one of the abutment surfaces (212*a*, 212*b*, 212*a*', 212*b*') of the recess (212, 212') in which it is located.

Figure 5A:
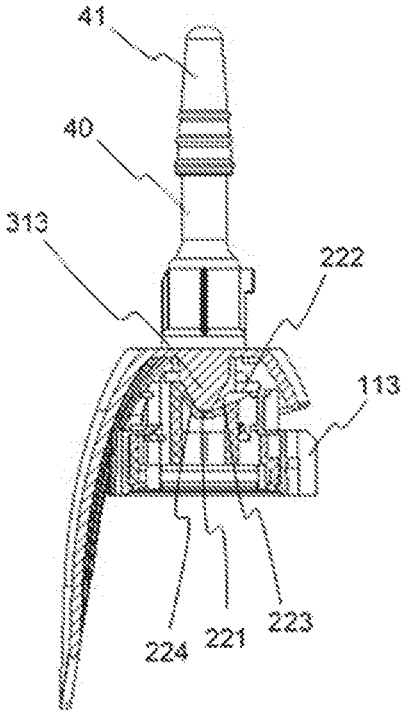
Figure 5B:
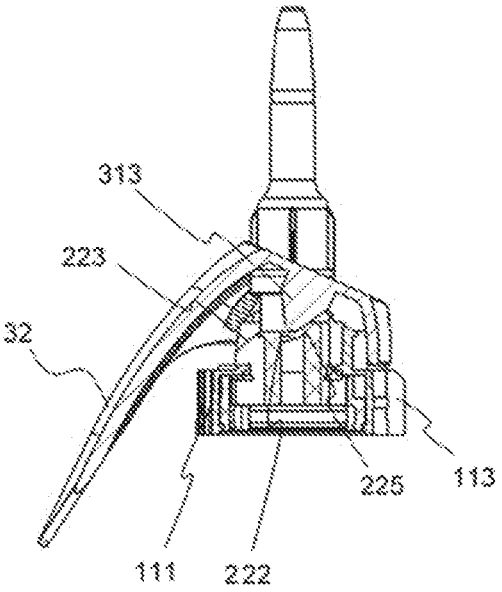

FIGS. 5*a* and 5*b* show, with the first embodiment, the pivoting of the lever (30) relative to the adjustment ring (10) when the is rotated relative to the insert (20), and the cam surface in particular. The second embodiment operates in the same way. Before the first use, the dispensing head is in principle in the closed position shown in FIG. 5*a*. In this closed position, the rib (112) of the adjustment ring bears against the abutment surface (212*a*) of the notch (212). The cam followers (313) of the lever are located facing the first landings (221) of the cam surface, in other words the lowest planes. In this position, the lever is in the low extreme position, the trigger in contact with the housing of the pressurized container (80) or a stop provided for this purpose. The user cannot press the trigger, and consequently, cannot actuate the valve. However, nothing prevents the user from raising the lever to the high extreme position. But there is no interest to do so. In the low extreme position, one of the inclined edges of the triangular cam followers preferably bears against the upstream stop surface (224) which can be, as in the present example, inclined like the corresponding edge of the triangular cam follower. The person skilled in the art understands that this inclined contact between the inclined edge of the cam follower (313) and the upstream stop surface (224) is not indispensable.

Starting from this closed position of the adjustment ring (10) and from the low extreme position of the lever (30), it is possible to rotate the adjustment ring (10) relative to the insert (20). In this case, the cam followers (313), each sliding on one of the cam half-surfaces, leave the first landing (221) and follow the ramp (223) causing the pivoting of the lever (30) in direction of the high extreme position, until the cam followers reach the second landing (222), higher than the first. In this intermediate position, the trigger (32) is spaced apart from the pressurized container (80) or from the stop against which it was resting in the low extreme position. This intermediate position does not necessarily correspond to the high extreme position; it is thus generally possible to manually raise the lever from the intermediate position to the high extreme position, even if there is no particular interest to do so. However, if the trigger is pressed in direction of the container, the lever pivots about its pivot axis (B), the cam followers (313) press on the second landings (222) causing the downward movement of the cam surfaces (22) and of the cannula (23). The latter, fitted onto the stem (81) of the valve, causes the downward movement of the stem and actuation of the valve. As soon as the user ceases to press on the lever, the valve closes, the stem (81) goes back up, taking with it the cannula (23) and the cam surface (22). In order to prevent the cam followers (313) from sliding radially out of the second landings (222) when the user actuates the trigger following a deformation of the cam followers towards the outside, it is possible to widen the second landings (222), forming for each of them a sort of platform protruding from the skirt (226) as is clearly visible for the first embodiment in FIGS. 3*a* and 3*c*, for example. These platforms are however not indispensable, and they can be omitted, as in the second embodiment.

Before the first use, the bridges (24) connecting the cam surface to the crown show the integrity of the product. During packaging, the stem (81) of the valve is inserted into the cannula and the crown (21) is fixed to the container. As long as the bridges are not broken, the cannula is not necessarily in close contact with the stem (81). At the time of the first use, the act of pressing the trigger causes the cam followers to press on the cam surface and the bridges to break (24). The tongues (25) slide in the guide grooves (213) when the cam surface/cannula unit is moved downwards to open the valve or upwards when the valve closes. These tongues and guide grooves ensure that the cam surface remains substantially in the same angular position as the crown (21) fixed to the container. This measure makes it possible to ensure that the rotation of the adjustment ring (10) does not cause a rotation of the cam surface (22), caused for example by the cam followers (313) pressing tangentially on the ramp (223) or on the stop surfaces (224, 225).

To facilitate assembly of the dispensing head and to ensure that the cam followers will face the first landings when the adjustment ring is in the closed position, an assembly index (26, 26') can be provided on the insert, preferably inside it.

The examples presented here show two cam half-surfaces each having two landings: a closed position landing (221) and an open position landing (222). To allow partial opening of the valve, it would be possible to provide intermediate landings placed in radial planes located between the two radial planes defined by the first and second landings. Each landing is then connected to the next by an inclined ramp. Similarly, one could dispense with at least the lower landing (221, 221'), or even the upper landing (222, 222'). The mere fact of holding between the fingers and the palm of the hand, on the one hand, the pressurized container to which the insert is fixed, and on the other hand, the lever fixed to the adjustment ring, can be sufficient to prevent a relative rotation of the adjustment ring and the insert during use. It is also possible to provide stop means to prevent a rotation of the ring in the direction of the closed position when the trigger is actuated.

Rather than blocking the insert on the container and causing the adjustment ring to rotate with the lever, the ring can be blocked with the lever and the cam surface can be caused to rotate.

FIG. 3*a* shows four recesses (212) distributed symmetrically on the crown (21). A single recess in the crown of the insert would however be sufficient. Likewise, the recess or recesses could be placed in the ring and the rib in the insert. Also, as many ribs (112) as recesses (212) could be provided.

The figures show dispensing heads for a high-flow type valve provided with an outlet rod (81) that can be tilted to clear large outlet orifices. The dispensing head is designed in such a way that this valve is not tilted, but moved axially. A similar dispensing head could be used in the same way to actuate a traditional male-type valve with the stem designed to be moved axially only. By modifying the insert slightly, in particular by providing it with an outlet rod directed downwards, the dispensing head of the invention could be used for a female-type valve.

LIST OF REFERENCES

1 Dispensing head
10, 10' Adjustment ring
11, 11' Tubular wall
111, 111' Retaining means/Retaining ring

112, 112' Rib
113, 113' Gripping fin
114, 114' Relief/Vertical grooves
12, 12' Annular wall
121, 121' Central opening
13, 13' Curved wall
131, 131' Projection/Pivot half-axles of the lever
20, 20' Insert
21, 21' Crown
211, 211' Fixing means/Retaining ring
212, 212' Recesses
212*a*/212*b* Abutment surfaces
212*a*/212*b'* Abutment surfaces
213, 213' Guide grooves
214' Outer wall
215' Inner skirt
216' Horizontal connecting wall
217' Vertical connecting wall
22, 22' Cam surface
221, 221' $1^{st}$ horizontal landing
222, 222' $2^{nd}$ horizontal landing
223, 223' Ramp
224, 224' $1^{st}$ stop surface
225, 225' $2^{nd}$ stop surface
226, 226' Skirt
227' Extension lugs
23, 23' Cannula
231, 231' Attachment means/Threading
24, 24' Bridges
25, 25' Tongues
251, 251' Tongue reinforcements
26, 26' Assembly index
30 Lever
31 Ring
311 Openings/Bearings of the pivot axis
312 Oblong opening
313 Cam followers
32 Trigger
40 Dispensing endpiece
41 Cap
80 Pressurized container
81 Outlet rod
82 Cup
A Main axis of symmetry
B Pivot axis of the lever

The invention claimed is:

1. Trigger-type dispensing head for actuating a stem of a valve of a pressurized container, comprising:
an insert provided with
a cam surface, and
cooperating means for cooperating with the stem of the valve of the container to actuate the valve when the cam surface is moved towards the pressurized container,
a ring,
a lever articulated on the ring, so that the lever can pivot relative to the ring about a pivot axis, the lever being provided with
a trigger, and
at least one cam follower configured to follow the cam surface,
the dispensing head being configured to allow relative rotation of the lever with respect to the cam surface about a main axis between a closed position in which the cam follower or followers cannot move the cam surface towards the container to actuate the valve, and an open position in which the cam follower or followers can press on the cam surface and move it towards the container, thus actuating the valve,
wherein
the insert is configured to be blocked in rotation relative to the container and to the stem of the valve,
the ring is an adjustment ring which is configured to rotate relative to the container and to the insert about the main axis to bring the lever and the cam follower or followers into the open or closed position,
the cam surface having at least one ramp inclined relative to a radial plane perpendicular to the main axis so as to connect two points offset angularly and located in two planes offset axially relative to the main axis.

2. Dispensing head according to claim 1, wherein the pivot axis of the lever is fixed on the ring.

3. Dispensing head according to claim 1, wherein the dispensing head is provided with tamper-evident means configured to show that the dispensing head has never been used.

4. Dispensing head according to claim 1, wherein the insert is provided with
a crown provided with fixing means for fixing it on the pressurized container,
the cam surface, and
a cannula configured to be fitted onto the stem of the pressurized container, the cam surface surrounding the cannula close to one of its ends, the other end of the cannula constituting an outlet opening for the product.

5. Dispensing head according to claim 4, wherein the crown comprises at least one axial guide groove, and the cam surface is provided with at least one tongue extending radially away from the crown, the tongue or tongues each being configured to penetrate and slide in the or one of the guide grooves.

6. Dispensing head according to claim 5, wherein the dispensing head is provided with tamper-evident means configured to show that the dispensing head has never been used, and wherein the tamper-evident means are constituted by at least one bridge which is broken at a time of a first use.

7. Dispensing head according to claim 6, wherein the cam surface is connected to the crown by the bridge or bridges which are each located between an end of one of the tongues and a bottom of one of the guide grooves so that when the bridge or bridges are broken, the tongue or tongues can slide in the guide groove or grooves.

8. Dispensing head according to claim 4, wherein the crown of the insert is configured to take place inside the adjustment ring, retaining means being provided to prevent a relative movement of the crown and of the adjustment ring in the axial direction while allowing a relative rotational movement about the main axis.

9. Dispensing head according to claim 1, wherein the cam surface is constituted by two identical cam half-surfaces arranged symmetrically relative to the main axis, and the lever is provided with two cam followers.

10. Dispensing head according to claim 1, wherein the cam surface or each of the cam half-surfaces is provided with two landings extending radially in two axially offset planes, the two landings being connected by a ramp.

11. Dispensing head according to claim 1, wherein the cam surface or each of the cam half-surfaces is configured to cause the lever to pivot, moving the trigger away from the pressurized container during the passage from the closed position to the open position by sliding of the cam follower or followers on the cam surface or the cam half-surfaces.

12. Dispensing head according to claim 1, wherein the insert is provided, with at least one recess open radially towards the outside and provided with two abutment surfaces, and the adjustment ring is provided with a rib extending radially towards the inside, the rib being configured to penetrate into the recess, and the abutment surfaces being configured to limit the rotation of the adjustment ring relative to the insert, thus blocking the movement of the rib in the recess between two extreme positions.

13. Dispensing head according to claim 12, wherein the at least one recess is provided in the crown.

14. Dispensing head according to claim 1, wherein the adjustment ring is provided on its outer face with gripping means.

15. Dispensing head according to claim 14, wherein the gripping means comprise at least one selected from the group consisting of (i) a fin extending radially towards the outside, and (ii) reliefs.

16. Dispensing head according to claim 1, wherein the adjustment ring is provided with a tubular wall closed at one of ends thereof by an annular wall forming a central opening, and with a curved wall extending axially, which curved wall is placed on an annular surface of the annular wall opposite from the tubular wall, partially surrounding the central opening, the pivot axis of the lever passing through the curved wall.

17. Dispensing head according to claim 1, wherein the pivot axis of the lever comprises two half-axles and two bearings, the half-axles being placed on one of the adjustment ring or the lever, and the two bearings being placed on the other of the adjustment ring or the lever.

18. Dispensing head according to claim 17, wherein the half-axles are placed on the curved wall.

19. Dispensing head according to claim 1, wherein the insert is provided with attachment means for attaching a dispensing endpiece.

20. Dispensing head according to claim 1, wherein the lever is provided with an oblong opening through which passes a portion of the insert.

* * * * *